US005365807A

United States Patent [19]

Darrah et al.

[11] Patent Number: 5,365,807

[45] Date of Patent: Nov. 22, 1994

[54] THROUGH-HOLE SOCKET

[76] Inventors: Scott A. Darrah, 7616 Wilderness Rd., Raleigh, N.C. 27613; Vincent Lee, No. 17, Lane 232, Section 6, Roosevelt Road, P.O. Box 29-29, Taipei, Taiwan, Prov. of China

[21] Appl. No.: 81,809

[22] Filed: Jun. 24, 1993

[51] Int. Cl.[5] ..... B25B 13/46

[52] U.S. Cl. ..... 81/60; 81/124.3; 81/177.85; 403/329; 403/108

[58] Field of Search ..... 81/60–63.1, 81/121.1, 124.3, 177.85, 185; 403/326, 329, 361, 108

[56] References Cited

U.S. PATENT DOCUMENTS

| | | | |
|---|---|---|---|
| 1,658,886 | 2/1928 | Dickey | 81/121.1 |
| 3,715,168 | 2/1973 | Kuhn | 81/121.1 X |
| 4,711,595 | 12/1987 | Magio et al. | 403/329 X |
| 4,722,252 | 2/1988 | Fulcher et al. . | |

OTHER PUBLICATIONS

Scot Tools brochure re Super Socket Systems, Scot Tools, Inc. of Mebane, N.C. (4 pages).

*Primary Examiner*—James G. Smith

*Attorney, Agent, or Firm*—Flynn, Thiel, Boutell & Tanis

[57] ABSTRACT

A socket tool for releasable securement to a wrench having a drive wheel provided with a drive opening. The tool includes a fastener-receiving part defining therein a fastener-receiving opening for nonrotatable driving engagement with a conventional fastener such as a nut or bolt head. A drive part is fixed to and projects axially from the other end of the fastener-receiving part, and is defined by an annular wall having an interior peripheral wall which defines an interior opening which projects axially through the drive part and coaxially communicates with the fastener-receiving opening. The drive part has an exterior peripheral wall of polygonal shape for nonrotatable driving engagement within the drive opening of the wrench. A ball detent arrangement is mounted on the drive part, and includes a bore formed radially through the annular wall and a ball movably disposed therein. The bore, where it communicates with the exterior peripheral wall, defines a mouth of smaller diameter than the ball to radially confine the ball within the bore while permitting the ball to project radially outwardly through the mouth. A spring is mounted on the annular wall and extends across the inner end of the bore and urges the ball radially outwardly.

12 Claims, 3 Drawing Sheets

THROUGH-HOLE SOCKET

FIELD OF THE INVENTION

This invention relates to a socket having a through-hole for accommodating a fastener and, in particular, relates to an improved detent mounted on the socket for securement to a wrench.

BACKGROUND OF THE INVENTION

The socket used with conventional wrenches typically has a drive hub provided with a square opening for receiving a square drive shank provided on a socket wrench. However, sockets have also been developed which have a cylindrical opening projecting coaxially through the drive hub for accommodating an elongate threaded rod, in which case the drive hub typically has an exterior hex surface for driving engagement within a drive opening formed in a special-type socket wrench. With this latter type socket, it is known to provide the drive hub of the socket with an O-ring which exteriorly surrounds the hex surface for engagement within an annular recess formed in the drive wheel of the socket wrench to axially secure the socket to the wrench, or conversely an O-ring is mounted on the drive wheel for engagement with an annular groove on the drive hub.

Accordingly, it is an object of this invention to provide a socket of this latter type, which socket includes an improved ball detent associated with the drive part so as to permit securement within a drive wrench while at the same time maximize the diameter of the through opening so as to accommodate a larger diameter rod therethrough.

In the improved socket of this invention, accordingly to a preferred embodiment, the drive hub of the socket has a cylindrical opening of maximum diameter extending axially therethrough in coaxial communication with the socket part. The hub part has an exterior surface, such as a hexagonal surface, for driving engagement with a wrench. A ball detent is associated with the sidewall defining the hub part. The ball detent includes a bore extending through the sidewall of the hub part, which bore is of a tapered configuration having a minimum diameter opening where it communicates with a flat of the hex surface. A ball is confined in the bore and has a diameter which exceeds the minimal diameter of the bore, so that a small portion of the ball projects outwardly of the opening beyond the exterior flat surface. A spring, preferably a C-spring, is confined within the through opening and has a shallow dimple for engaging an inner portion of the ball to urge it radially outwardly so that the ball is held in position by the smaller diameter mouth of the bore. When the socket is inserted into a wrench, the ball deflects inwardly against the resiliency of the spring to permit passage into the wrench opening, which spring urges the ball outwardly into engagement with the associated detent groove or recess formed in the drive wheel of the wrench.

Other objects and purposes of the invention will be apparent to persons familiar with structures of this general type upon reading the following specification and inspecting the accompanying drawings.

Figure 1:
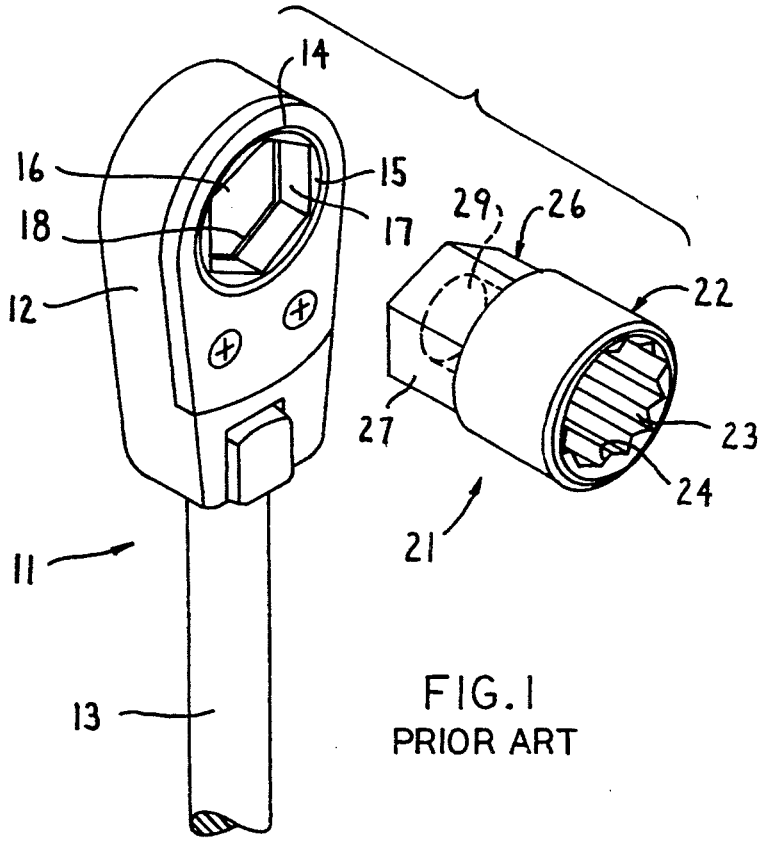
FIG. 1 PRIOR ART
FIG. 1 is a perspective view which illustrates a conventional though-hole socket and its cooperation with a conventional wrench.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated a conventional ratchet wrench 11 which has a head end 12 provided on one end of an elongate handle 13. The head end 12 has an opening 14 therethrough in which a drive wheel 15 is rotatably supported. This drive wheel 15 cooperates with a pawl structure (not shown) in a conventional manner for permitting rotational movement of the drive wheel 15 in one or both directions relative to the wrench. This drive wheel 15 has a tool-accommodating opening 16 formed therein and extending axially therethrough, which opening is defined by an inner annular-extending drive surface 17 defined on the drive wheel. The drive surface 17 is of a toothed or hexagonal configuration so as to permit nonrotatable driving engagement with a hub part of a socket tool, as explained below. This drive surface 17 may also have an annular groove or recess 18 formed therearound for accommodating a detent on the hub part of the socket tool.

A socket tool 21 is adapted to be drivingly engaged with the head part 12 of the wrench 11. The socket tool 21 includes a main cylindrical body part 22 having a fastener-receiving opening 23 extending axially thereof. This opening 23 is defined by a surrounding annual surface 24 which is also typically of a toothed or hexagonal configuration so as to create a nonrotatable engagement with the exterior polygonal configuration of a fastener such as a nut or bolt head, the latter typically being of square or hexagonal exterior configuration.

The socket tool 21 also includes a shank or hub part 26 which projects axially from and is fixedly and integrally formed with the cylindrical body part 22. This hub part 26 has a noncircular exterior configuration, typically a hexagonal exterior surface 27, so as to be axially slidably inserted into and nonrotatably engaged with the drive surface 17 defining the opening 16 of drive wheel 15. Hub part 26 also typically mounts thereon a detent element, such as a spring-urged ball for reception within the shallow recess 18. Alternatively, the hub part 26 may be provided with a surrounding elastomeric O-ring which is intended for disposition within the shallow groove 18.

The hub part 26 also has an opening 29 extending coaxially therethrough in communication with the opening 23 defined in the main body part 22 of the socket tool. This opening 29, however, is typically of much smaller cross section, and will permit axial passage therethrough of only a small diameter rod.

The wrench 11 and socket tool 21 as described above, and as illustrated by FIG. 1, are conventional. Reference is made to U.S. Pat. Nos. 4,328,720 and 3,186,265 which illustrate these conventional structures in greater detail.

Figure 2:
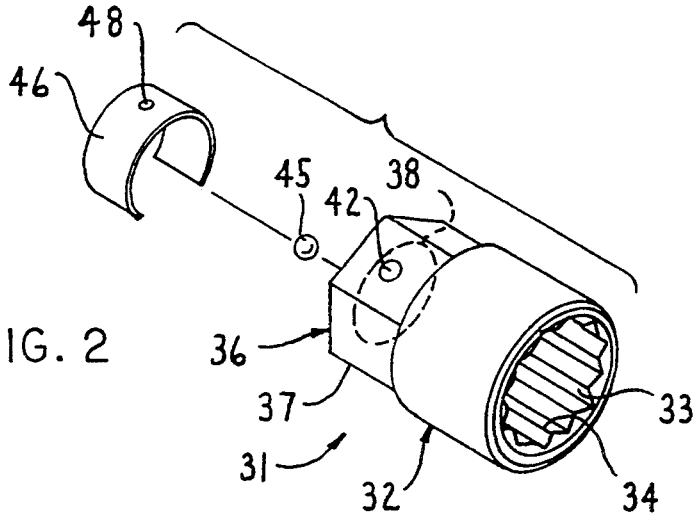
FIG. 2 is an exploded perspective view, illustrating the improved through-hole socket of this invention.
Figure 3:
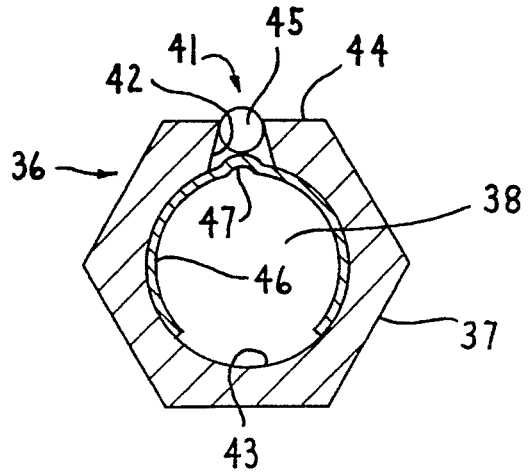
FIGS. 3 and 4 are enlarged cross sectional views respectively taken transversely and axially through the socket for illustrating the improved ball detent arrangement.
Figure 4:
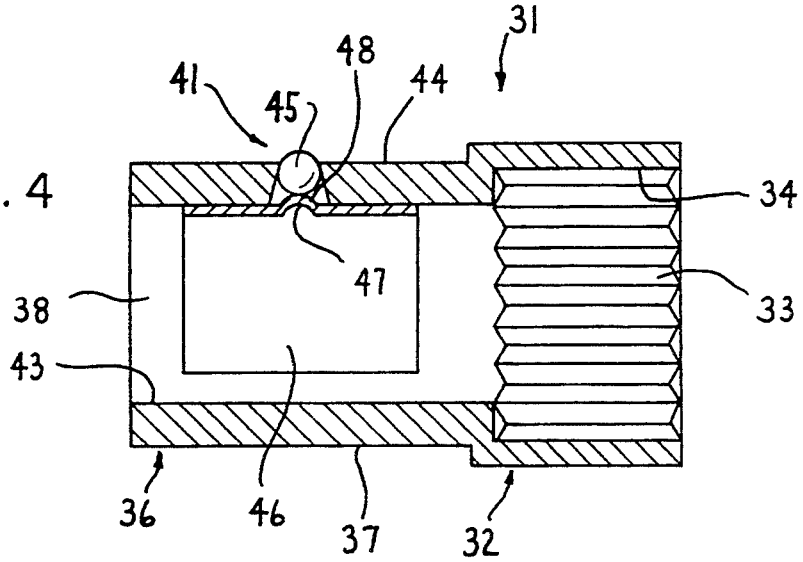

Referring now to FIGS. 2–4, there is illustrated the improved socket tool 31 according to the present invention. This socket tool 31 again includes a main cylindrical body part 32 having a fastener-receiving opening 33 defined by a surrounding drive surface 34 of a toothed or hexagonal configuration for engaging a bolt head or nut. This cylindrical body part 32 is of a conventional construction.

The socket tool 31 includes a drive shank or hub part 36 which projects axially from one end of the cylindrical body part 32 and is integrally and fixedly associated therewith to define a one-piece structure. This hub part 36 has a generally cylindrical opening 38 extending axially therethrough in coaxial communication with the opening 33 of the body part 32. Hub part 36 also has an exterior surface 37 of noncylindrical configuration, typically a polygonal (i.e. hexagonal) configuration, so as to be axially insertable into and disposed in driving engagement with the drive surface 17 of the drive wheel 15 associated with a conventional ratchet wrench.

The drive or hub part 36 has a detent assembly 41 associated therewith for permitting releasable axial securement of the part 36 within the drive opening 16 of the drive wheel 15. This detent assembly 41, as illustrated by FIGS. 3 and 4, includes a bore 42 which extends radially through the wall of the hub part 36. That is, this bore 42 projects radially outwardly from the inner cylindrical wall 43 which defines the through opening 38, and opens outwardly through one of the flats 44 which define the exterior hex surface 37. The bore 42 communicates with the flat 44 substantially at the center or middle thereof. Bore 42 is of a converging truncated conical configuration as it projects outwardly so that it defines an opening or mouth 43 of minimal diameter where it intersects the flat 44.

The detent assembly 41 also includes a spherical detent member or ball 45 positioned within the bore 42. This ball 45 has a diameter which exceeds the minimal thickness of the annular wall defining the hub part 36, with the diameter of this ball 45 being greater than the diameter of the mouth 43 so that the mouth constrains the ball and prevents it from passing radially outwardly of the bore, while at the same time the mouth 43 enables the ball 45 to project radially outwardly a limited radial extent beyond the plane of the flat 44.

When the ball 45 is held in the position wherein it protrudes outwardly of the mouth 43 as illustrated by FIG. 3, the ball 45 also protrudes radially inwardly a limited extent beyond the inner surface of the opening 38 so as to be engaged with a retainer spring 46. This spring 46, in the illustrated embodiment, is preferably of a C-shaped configuration so as to extend through an angle preferably in excess of 180°. This C-shaped spring 46 normally has an outer diameter, when in a relaxed or nondeformed condition, which is slightly greater than the diameter of the opening 38. This requires that the spring 46 be slightly resiliently compressed so as to be inserted into the opening 38, with the spring then being released so as to resiliently expand outwardly into snug engagement with the wall defining the opening 38. In this expanded condition of the spring, it is still slightly resiliently compressed that the tendency for the spring to outwardly resiliently expand causes the spring to snugly grip the will defining the opening 38.

The C-shaped spring 46, substantially midway between the ends thereof, is provided with a shallow radially outwardly projecting recess or dimple 47 which hence defines a radially outwardly extending projection 48. The projection 48 extends radially into the bore 42 and has a rounded convex exterior surface which contacts the radially inner portion of the ball 45 so as to maintain the position of the ball and at the same time impose an outward resilient force thereon.

Figure 5:
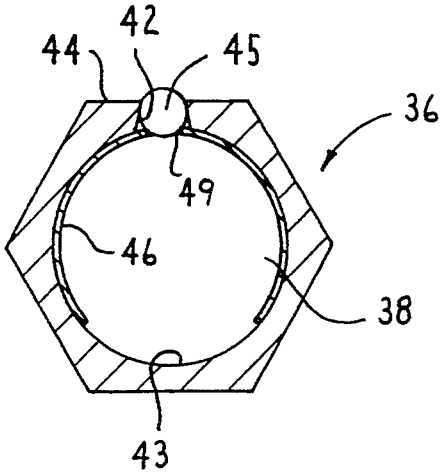
FIG. 5 is a cross sectional view similar to FIG. 3 but showing a variation.

To permit further reduction in wall thickness, and/or use of a larger diameter detent ball, the projection 48 can be dimpled radially inwardly to form a concave seat for the ball. Alternately, the projection 48 can be replaced by a small circular opening 49 (FIG. 5) formed through the thickness of the spring, which opening is of smaller diameter than the ball and acts as a seat for the radially inner part of the ball.

The C-shaped spring 46 is preferably formed from thin sheetlike metal spring material of several mils thickness so as to possess the desired resiliency, while at the same time the extreme thinness of the spring enable its disposition within the opening 38 without significantly decreasing the diameter of the opening through the socket tool.

In utilization of the improved socket tool 31 according to the present invention, the hub part 36 is moved axially into the opening 16 of the drive wheel 15 associated with the ratchet wrench so that the exterior hex surface 37 of the hub part creates a nonrotatable and hence a driving engagement with the drive wheel 15. During this axial insertion of the hub part into the opening 16, however, the detent ball 45 is radially displaced inwardly during its passage axially into the opening 16 until the ball is aligned with the shallow groove 18. This is permitted by radial compression of the C-shaped spring 46, the latter enabling the central portion of the spring member as disposed under the ball to be depressed radially inwardly. When the ball becomes aligned with the shallow groove 18, however, the resilient outward force imposed on the ball 45 by the C-spring 46 causes the ball to again move outwardly, as limited by the mouth 43, so as to project into the groove 18 and axially retain the socket tool 31 within the opening of the drive wheel 15.

During removal of the socket member 31 from the drive wheel, the detent obviously works in the reverse fashion.

With the improve socket tool 31 of this invention, by having a through-hole 42 which accommodates the ball 45, the wall of the hub part 36 can be of minimal radial thickness, thereby enabling the diameter of the interior through opening 38 to be maximized relative to the standardized exterior size and configuration of the hex surface 37. At the same time, the configuration of the C-shaped spring 46 provides the necessary resiliency for movement of the detent ball 45, and does so without requiring any significant radial obstruction or thickness. The resulting through opening 38 and its coaxial communication with the socket-receiving drive opening 33 results in the opening 38 being of a maximum diameter relative to the exterior hex surface 37 so as to accommodate within the opening 38 a rod of larger diameter than has previously been possible. At the same time, the ball 45 can be radially retained in the bore 42 without the use of retainer clips and the like.

In the improved socket tool 31 of FIG. 3, when the drive hub 36 is dimensioned to provide a standard ¾ inch hex drive (that is, a ¾ inch dimension perpendicularly between opposed flats 44), the through opening 38 can be large enough to accommodate passage of a ½ inch diameter rod therethrough.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a socket tool having a socketlike opening which opens coaxially inwardly of the tool from one end thereof for creating a nonrotatable griping engagement with a fastener, such as a conventional nut or bolt head of polygonal shape, when the fastener is positioned within the socketlike opening, said socket tool including a fastener-receiving part which defines therein the socketlike opening, said fastener-receiving part having an annular wall which surrounds and defines the socketlike opening, said annular wall having an interior annular surface which is of an noncylindrical configuration to create a nonrotatable gripping engagement with a conventional fastener when the fastener is axially slidably inserted into the socketlike opening, the socket tool also including a drive end part which is coaxially fixed to said fastener-receiving part and which defines the other end of said socket tool, said drive end part having a surrounding exterior peripheral wall which projects axially inwardly from said other end and terminates at a shoulder and which of a noncircular profile having a size and flat-sided configuration so as to be axially slidably and nonrotatable engageable within a tool-receiving opening of a ratchet wrench, said drive end part also having an interior opening which is formed within the interior thereof and which projects axially inwardly from said other end for coaxial communication with said socketlike opening, said interior opening being defined by a surrounding interior peripheral wall so that said drive end part is also defined by an annular wall, the improvement comprising a ball-type detent means mounted on said drive end part for cooperation with the tool-receiving opening of the ratchet wrench, said detent means including a bore formed in and extending generally radially through the annular wall of said drive end part, said bore projecting generally perpendicularly relative to and intersecting a flat sidewall of said drive end part substantially adjacent a center portion thereof, said bore where is communicates with said flat sidewall defining a first opening of a first diameter, said bore where it communicates with the inner peripheral wall defining a second opening of a second diameter which is greater than said first diameter, a ball disposed within said bore and having a third diameter which is smaller than said second diameter but greater than said first diameter so that said ball projects radially outwardly beyond said first opening but is constrained from moving radially outwardly through said bore, and spring means mounted on said drive end part and engaging a radially inner side of said ball for normally resiliently urging the ball outwardly of said bore, said spring means being disposed adjacent a radially inner end of said bore for preventing said ball from passing into said interior opening, said spring means comprising a one-piece spring member having a generally C-shaped configuration and constructed from a thin platelike spring material, said spring member being positioned within and extending partially around said interior opening so that said spring member resiliently grips said interior peripheral wall, said spring member having a central portion thereof which extends across the radial inner end of said bore and resiliently supportingly engages a radially inner side of said ball.

2. A socket tool according to claim 1, wherein said bore is of a truncated conical configuration which is of decreasing diameter as the bore projects radially outwardly from said interior peripheral wall to said exterior peripheral wall.

3. A socket tool according to claim 1, wherein the central portion of the spring member has a radially outwardly projecting dimple structure which contacts the radially inner side of the ball.

4. A socket tool according to claim 3, wherein the C-shaped spring member is maintained in a partially radially inwardly compressed condition when engaged with the interior peripheral wall of said interior opening.

5. A socket tool according to claim 1, wherein the central portion of the spring member has a small opening therethrough which defines a seat for contact with the radially inner side of the ball.

6. A socket tool for a polygonal-shaped fastener such as a nut or bolt head, comprising:

a fastener engaging part having a fastener-receiving opening projecting coaxially inwardly from one end thereof, said fastener-receiving part having an annular wall which surrounds said fastener-receiving opening and defines thereon a noncylindrical interior annular surface for creating a nonrotatable engagement with a fastener which can be axially slidably inserted into the fastener-receiving opening;

a drive part fixedly secured to and projecting axially from the other end of said fastener-receiving part, said drive part being adapted for insertion into a drive opening of a drive wheel associated with a wrench;

said drive part being defined by an annular wall having exterior and interior annular surfaces, said interior annular surface defining and surrounding a generally cylindrical interior opening which projects axially through the drive part in communication and coaxial alignment with said fastener-receiving opening for permitting a rod to project axially entirely through said socket tool, and said exterior annular surface being of a noncircular configuration and having a plurality of flat side surfaces so that said drive part can be inserted into said drive opening in nonrotatable driving engagement with the wrench;

resilient detent means mounted on said drive part to resiliently axially secure the socket tool to the drive wheel when the socket tool is inserted into the drive opening, said resilient detent means including a bore formed in and extend radially through said annular wall and terminating at inner and outer openings which are respectively formed in the interior and exterior annular surfaces of the drive part, said outer opening being located in one of said flat side surfaces, said outer opening having a diameter smaller than said inner opening, a detent ball movably positioned within said bore and having a diameter greater than said outer opening so that said ball can project radially partway through said outer opening but is captivated within said bore, and spring means mounted on said annular wall and extending transversely across said bore adjacent a radially inner end thereof for contact with a radially inner side of said ball for radially urging said ball outwardly of said bore, said spring means comprising a one-piece C-shape spring constructed of a thin platelike material and disposed within said interior opening so as to extend transversely across and generally close off the radially inner end of said bore, said C-shape spring being resiliently engaged with and extending circumferentially partially around said interior annular surface so as to not interfere with or prevent a rod projecting axially entirely through said socket tool.

7. A socket tool according to claim 6, wherein said C-shaped spring extends circumferentially around said interior opening through an angle of at least 180°.

8. A socket tool according to claim 6, wherein said bore is of a truncated conical configuration which is of decreasing cross section as the bore projects radially outwardly.

9. A socket tool according to claim 6, wherein the central portion of the spring member has a radially outwardly projecting dimple structure which contacts the radially inner side of the ball.

10. A socket tool according to claim 6, wherein the central portion of the spring member has a small opening therethrough which defines a seat for contact with the radially inner side of the ball.

11. A socket tool for releasable securement to a wrench having a drive wheel provided with a drive opening, said tool comprising:

a fastener-receiving part defining therein a fastener-receiving opening which opens axially inwardly from one end of said tool, said fastener-receiving opening being of noncircular cross section and defined by a surrounding sidewall for creating a nonrotatable driving engagement with a polygonal-shaped contour of a conventional fastener such as a nut or bolt head;

a drive part fixed to and projecting axially from the other end of said fastener-receiving part, said drive part being defined by a generally annular wall having an interior peripheral wall which surrounds and defines an interior opening which projects axially through the drive part and coaxially communicates with the fastener-receiving opening for permitting a rod to project axially entirely through said socket tool, said drive part having an exterior peripheral wall of a polygonal shape for nonrotatable driving engagement within the drive opening of the wrench; and a ball detent arrangement mounted on the annular wall of the drive part for releasable securement of the drive part to the wrench, said ball detent arrangement including a bore formed radially through the annular wall and having a ball movably disposed therein, said bore where it communicates with the exterior peripheral wall being defined by a reduced-diameter mouth which is of smaller diameter than the ball so as to radially confine the ball within the bore while permitting the ball to project radially outwardly through the mouth, and platelike spring means stationarily mounted on the annular wall and extending generally across the radially inner end of the bore and engaged with the ball for imposing a radially outwardly resilient force thereagainst, said spring means comprising a one-piece platelike spring member constructed of a thin platelike spring material, said spring member being engaged with the interior peripheral surface Of said interior opening with said spring member extending generally transversely across the radially inner end of said bore, said spring member being disposed substantially in its entirety in engagement with said interior peripheral wall and positioned entirely at the periphery of said interior opening so as to permit a rod to project axially entirely through the socket tool.

12. A socket tool according to claim 11, wherein said one-piece spring member has a generally C-shaped configuration and is positioned within and extends partially around said interior opening so that said spring member resiliently grips said interior peripheral wall, said spring member having a central portion thereof which extends across the radial inner end of said bore and resiliency supportingly engages a radially inner side of said ball.

* * * * *

UNITED STATES PATENT AND TRADEMARK OFFICE

CERTIFICATE OF CORRECTION

PATENT NO. : 5,365,807

DATED : November 22, 1994

INVENTOR(S) : Scott A. Darrah, et al.

It is certified that error appears in the above-indentified patent and that said Letters Patent is hereby corrected as shown below:

Column 5, line 58; change "is" to ---it---.

Column 8, line 32; change "Of" to ---of---.

line 46; change "resiliency" to ---resiliently---.

Signed and Sealed this

Twenty-eight Day of March, 1995

*Attest:*

*Attesting Officer*

BRUCE LEHMAN

*Commissioner of Patents and Trademarks*